US009808093B2

(12) United States Patent
Rawls-Meehan et al.

(10) Patent No.: US 9,808,093 B2
(45) Date of Patent: Nov. 7, 2017

(54) ADJUSTABLE BED APPARATUS AND METHODS INCORPORATING LUMBAR AND NECK SUPPORTS

(71) Applicant: ASCION, LLC, Bloomfield Hills, MI (US)

(72) Inventors: Martin B. Rawls-Meehan, Franklin, MI (US); Man-Chi Liu, Bloomfield Hills, MI (US); Qianyu Liang, Auburn Hills, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 0 days.

(21) Appl. No.: 15/066,114

(22) Filed: Mar. 10, 2016

(65) Prior Publication Data

US 2016/0262549 A1 Sep. 15, 2016

Related U.S. Application Data

(60) Provisional application No. 62/130,707, filed on Mar. 10, 2015.

(51) Int. Cl.

| | |
|---|---|
| ***A47C 20/08*** | (2006.01) |
| ***A61G 7/015*** | (2006.01) |
| ***A47C 20/04*** | (2006.01) |
| ***A47C 20/02*** | (2006.01) |
| ***A61G 7/005*** | (2006.01) |
| ***A61G 7/002*** | (2006.01) |
| ***A47C 7/46*** | (2006.01) |

(52) U.S. Cl.

CPC ..... *A47C 20/08* (2013.01); *A47C 7/467* (2013.01); *A47C 20/027* (2013.01); *A47C 20/04* (2013.01); *A47C 20/041* (2013.01); *A61G 7/002* (2013.01); *A61G 7/005* (2013.01); *A61G 7/015* (2013.01)

(58) Field of Classification Search

CPC ..... A61G 7/002; A61G 7/005; A61G 7/015; A61G 7/065; A61G 7/07; A61G 7/072; A61G 7/05769; A61G 7/05776; A47C 20/027; A47C 20/04; A47C 20/041; A47C 20/08; A47C 7/467

See application file for complete search history.

(56) References Cited

U.S. PATENT DOCUMENTS

| | | | | |
|---|---|---|---|---|
| 4,309,783 A * | 1/1982 | Cammack | ..... | A47C 20/048 5/615 |
| 4,527,298 A * | 7/1985 | Moulton | ..... | A61G 7/002 5/615 |
| 5,331,698 A * | 7/1994 | Newkirk | ..... | A61G 13/0009 5/602 |

(Continued)

*Primary Examiner* — Peter M Cuomo
*Assistant Examiner* — David R Hare
(74) *Attorney, Agent, or Firm* — Marshall, Gerstein & Borun LLP

(57) ABSTRACT

The disclosure generally relates to an adjustable bed apparatus, in particular an adjustable bed foundation. The adjustable foundation includes independently adjustable lumbar and/or neck support structures on an adjustable back/head section of the adjustable bed foundation. In some embodiments, the lumbar and neck support structures include inflatable air bladder structures. In other embodiments, the lumbar and neck support structures include mechanically actuatable subsections of the adjustable back/head section of the adjustable bed foundation.

8 Claims, 8 Drawing Sheets

(56) References Cited

U.S. PATENT DOCUMENTS 5,437,607 A * 8/1995 Taylor ..... A61H 1/00 5/915
6,012,186 A * 1/2000 Soltani ..... A47C 20/048 5/613
6,276,011 B1 * 8/2001 Antinori ..... A47C 20/041 5/613
6,499,167 B1 * 12/2002 Ellis ..... A61G 7/00 5/709
6,874,182 B2 * 4/2005 L'Hegarat ..... A61G 13/08 5/612
7,321,811 B1 1/2008 Rawls-Meehan
7,465,280 B2 12/2008 Rawls-Meehan
7,805,785 B2 10/2010 Rawls-Meehan
7,930,783 B2 4/2011 Rawls-Meehan
7,933,669 B2 4/2011 Rawls-Meehan
7,979,169 B2 7/2011 Rawls-Meehan
8,019,486 B2 9/2011 Rawls-Meehan
8,032,263 B2 10/2011 Rawls-Meehan
8,032,960 B2 10/2011 Rawls-Meehan
8,046,114 B2 10/2011 Rawls-Meehan
8,046,115 B2 10/2011 Rawls-Meehan
8,046,116 B2 10/2011 Rawls-Meehan
8,046,117 B2 10/2011 Rawls-Meehan
8,050,805 B2 11/2011 Rawls-Meehan
8,069,512 B2 12/2011 Rawls-Meehan
8,078,336 B2 12/2011 Rawls-Meehan
8,078,337 B2 12/2011 Rawls-Meehan
8,150,562 B2 4/2012 Rawls-Meehan
8,375,488 B2 2/2013 Rawls-Meehan
8,565,934 B2 10/2013 Rawls-Meehan
8,682,457 B2 3/2014 Rawls-Meehan
8,910,328 B2 * 12/2014 Clenet ..... A61G 7/015 5/600
9,049,942 B2 * 6/2015 Huang ..... A47C 20/041
2004/0103476 A1 * 6/2004 Barcesat ..... A47C 20/041 5/618
2005/0114998 A1 * 6/2005 Leventhal ..... A47C 20/048 5/615
2009/0178201 A1 * 7/2009 Lujan ..... A47C 20/027 5/618
2009/0211028 A1 * 8/2009 Richmond ..... A47C 20/041 5/618
2010/0287704 A1 * 11/2010 Hibler ..... A47C 20/041 5/613
2012/0057685 A1 3/2012 Rawls-Meehan
2013/0081205 A1 * 4/2013 Frondorf ..... A61G 7/015 5/613
2014/0041121 A1 * 2/2014 Shan ..... A47C 21/006 5/618
2014/0325761 A1 11/2014 Rawls-Meehan
2016/0037936 A1 * 2/2016 Nomura ..... A47C 20/04 5/618

* cited by examiner

ADJUSTABLE BED APPARATUS AND METHODS INCORPORATING LUMBAR AND NECK SUPPORTS

CROSS REFERENCE TO RELATED APPLICATION

Priority is claimed to U.S. Provisional Application No. 62/130,707 (filed Mar. 10, 2015), which is incorporated herein by reference in its entirety.

STATEMENT OF GOVERNMENT INTEREST

None.

BACKGROUND OF THE DISCLOSURE

Field of the Disclosure

The disclosure generally relates to an adjustable bed apparatus, in particular an adjustable bed foundation. The adjustable foundation includes independently adjustable lumbar and/or neck support structures on an adjustable back/head section of the adjustable bed foundation.

SUMMARY

In one aspect, the disclosure relates to an adjustable bed comprising: (a) a mattress support surface comprising (i) a first deck support section corresponding to a back and head portion of the mattress support surface, and (ii) a second deck support section pivotally attached to the first deck support section; (b) an inflatable lumbar support laterally extending across the first deck support section and disposed on an upper surface of the first deck support section; and (c) an inflatable neck support laterally extending across the first deck support section and disposed on an upper surface of the first deck support section. In an alternative aspect, the adjustable bed comprises the inflatable lumbar support and the inflatable neck support is an optional component or omitted from the support system. In another alternative aspect, the adjustable bed comprises the inflatable neck support and the inflatable lumbar support is an optional component or omitted from the support system.

Various embodiments and refinements of the adjustable bed are possible.

In a refinement, the inflatable lumbar support is positioned in a bottom region of the first deck support section.

In another refinement, the inflatable neck support is positioned in a top region of the first deck support section.

In another refinement, the inflatable lumbar support extends at least 60% of the mattress support surface lateral width.

In another refinement, the inflatable neck support extends at least 60% of the mattress support surface lateral width.

In another refinement, the inflatable lumbar support is a single inflatable bladder extending across the first deck support section.

In another refinement, the inflatable lumbar support comprises a plurality of inflatable bladders extending across the first deck support section.

In another refinement, the inflatable neck support is a single inflatable bladder extending across the first deck support section.

In another refinement, the inflatable neck support comprises a plurality of inflatable bladders extending across the first deck support section.

In another refinement, the adjustable bed further comprises a means for supplying pressure to the inflatable lumbar support and the inflatable neck support.

In another refinement, the adjustable bed further comprises a flexible lumbar pressure distribution member mounted to the first deck support section and at least partially covering or enclosing the inflatable lumbar support.

In another refinement, the adjustable bed further comprises a flexible neck pressure distribution member mounted to the first deck support section and at least partially covering or enclosing the inflatable neck support.

In another aspect, the disclosure relates to an adjustable bed comprising: (a) a stationary bed frame; and (b) a mattress support surface supported by the stationary bed frame and comprising (i) a first deck support section corresponding to a back and head portion of the mattress support surface, and (ii) a second deck support section pivotally attached to the first deck support section; the first deck support section comprising: a longitudinally extending support frame pivotally attached to the second deck support section; a back support deck section fixedly mounted to an upper surface of a middle section of the support frame; a first actuator having (A) a first end mounted to one or more of the second deck support section and the stationary bed frame, and (B) a second end mounted to the support frame, wherein the first actuator is adapted to move the support frame between articulated and substantially flat positions relative to the stationary bed frame; a lumbar support deck section pivotally mounted to the second deck support section and positioned above an upper surface of a bottom section of the support frame; a second actuator having (A) a first end mounted to the support frame, and (B) a second end mounted to the lumbar support deck section, wherein the second actuator is adapted to move the lumbar support deck section between articulated and substantially flat positions relative to the support frame; a neck support deck section pivotally mounted to the support frame and positioned above an upper surface of a top section of the support frame; and a third actuator having (A) a first end mounted to the support frame, and (B) a second end mounted to the neck support deck section, wherein the third actuator is adapted to move the neck support deck section between articulated and substantially flat positions relative to the support frame. In an alternative aspect, the neck support deck section and the third actuator are optional components of or omitted from the first deck support section. In another alternative aspect, the neck support deck section and the third actuator are optional components of or omitted from the first deck support section.

In some embodiments, the first end of the first actuator has a fixed pivotal attachment to the one or more of the second deck support section and the stationary bed frame, and the second end of the first actuator has a fixed pivotal attachment to the support frame. In some embodiments, the first end of the second actuator has a fixed pivotal attachment to the support frame, and the second end of the second actuator has a floating pivotal attachment to the lumbar support deck section. In some embodiments, the first end of the third actuator has a fixed pivotal attachment to the support frame, and the second end of the third actuator has a floating pivotal attachment to the neck support deck section.

Various embodiments and refinements of the adjustable bed are possible.

In a refinement, the mattress support surface further comprises (iii) a third deck support section pivotally attached to the second deck support section, and (iv) optionally a fourth deck support section pivotally attached to the third deck support section.

In another refinement, the bed further comprises a mattress positioned above the mattress support surface. The mattress can be selected from the group consisting of a spring mattress, a coil mattress, a memory foam mattress, and an air mattress.

In another refinement, the adjustable bed comprises first and second mattress support surfaces arrange in a side-by-side configuration, and first and second inflatable lumbar supports and inflatable neck supports positioned on the respective first deck support sections.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to an adjustable bed apparatus, in particular an adjustable bed foundation. The adjustable foundation includes independently adjustable lumbar and/or neck support structures on an adjustable back/head section of the adjustable bed foundation. In some embodiments, the adjustable foundation includes the adjustable lumbar support structures but not the neck support structures. In some embodiments, the adjustable foundation includes the adjustable neck support structures but not the lumbar support structures. In some embodiments, the lumbar and neck support structures include inflatable air bladder structures. In other embodiments, the lumbar and neck support structures include mechanically actuatable subsections of the adjustable back/head section of the adjustable bed foundation.

Figure 1:
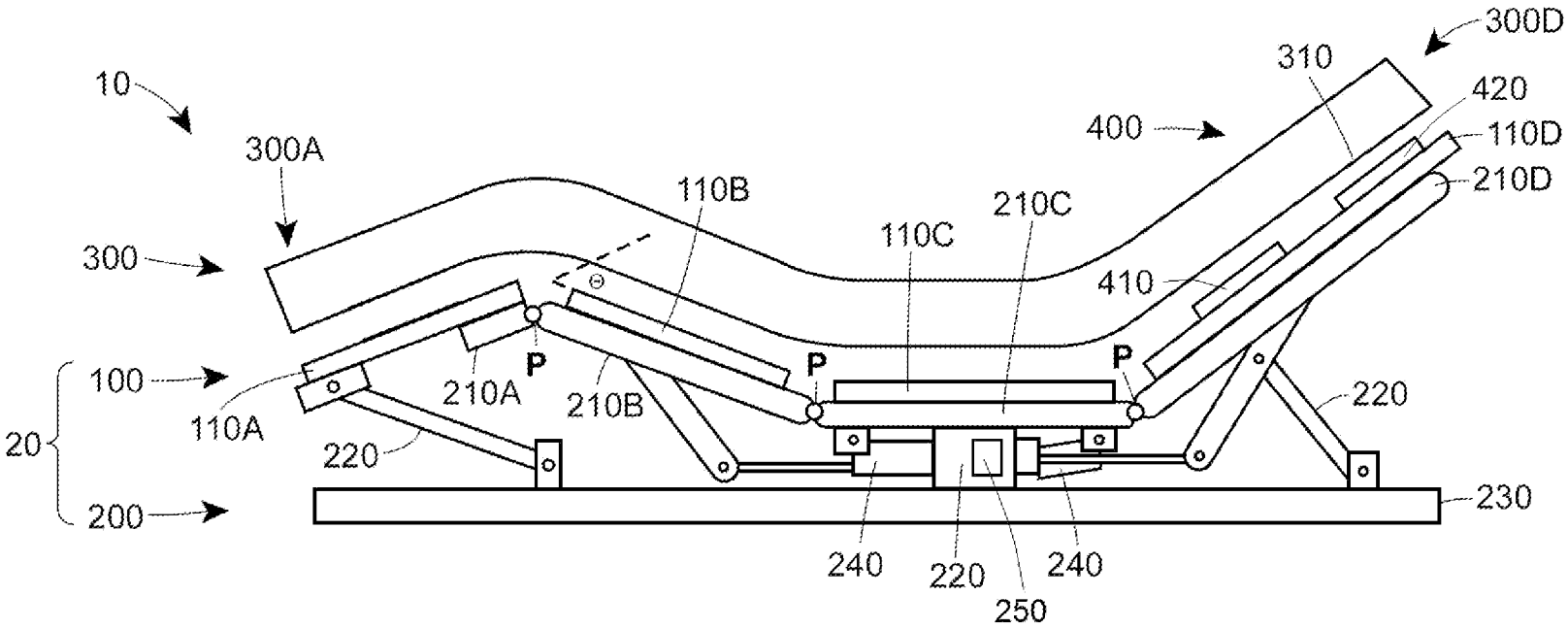
FIG. 1 is a side view of an adjustable bed according to the disclosure.
Figure 2:
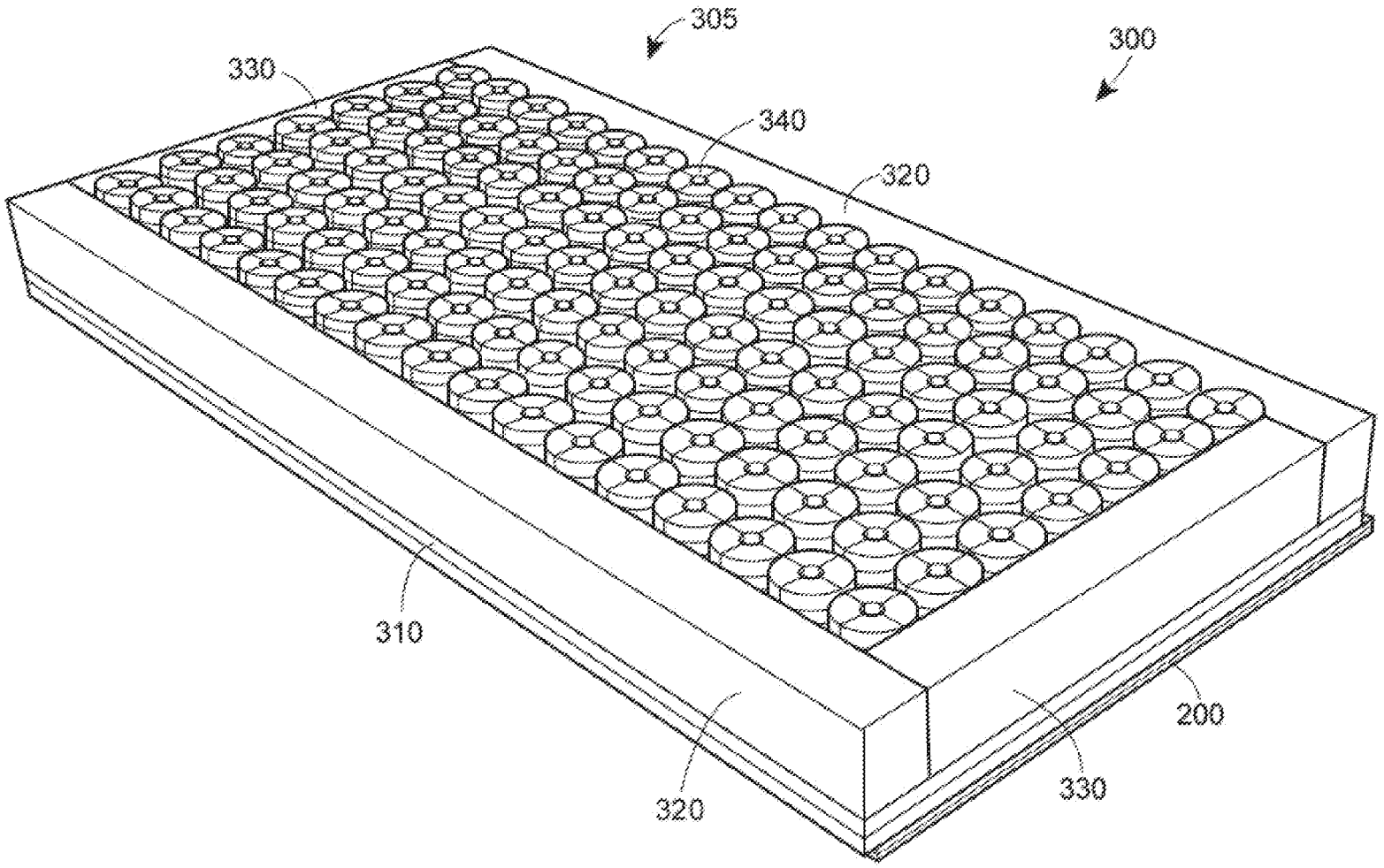
FIG. 2 is a perspective view of a mattress for use with the adjustable bed of FIG. 1.
Figure 3:
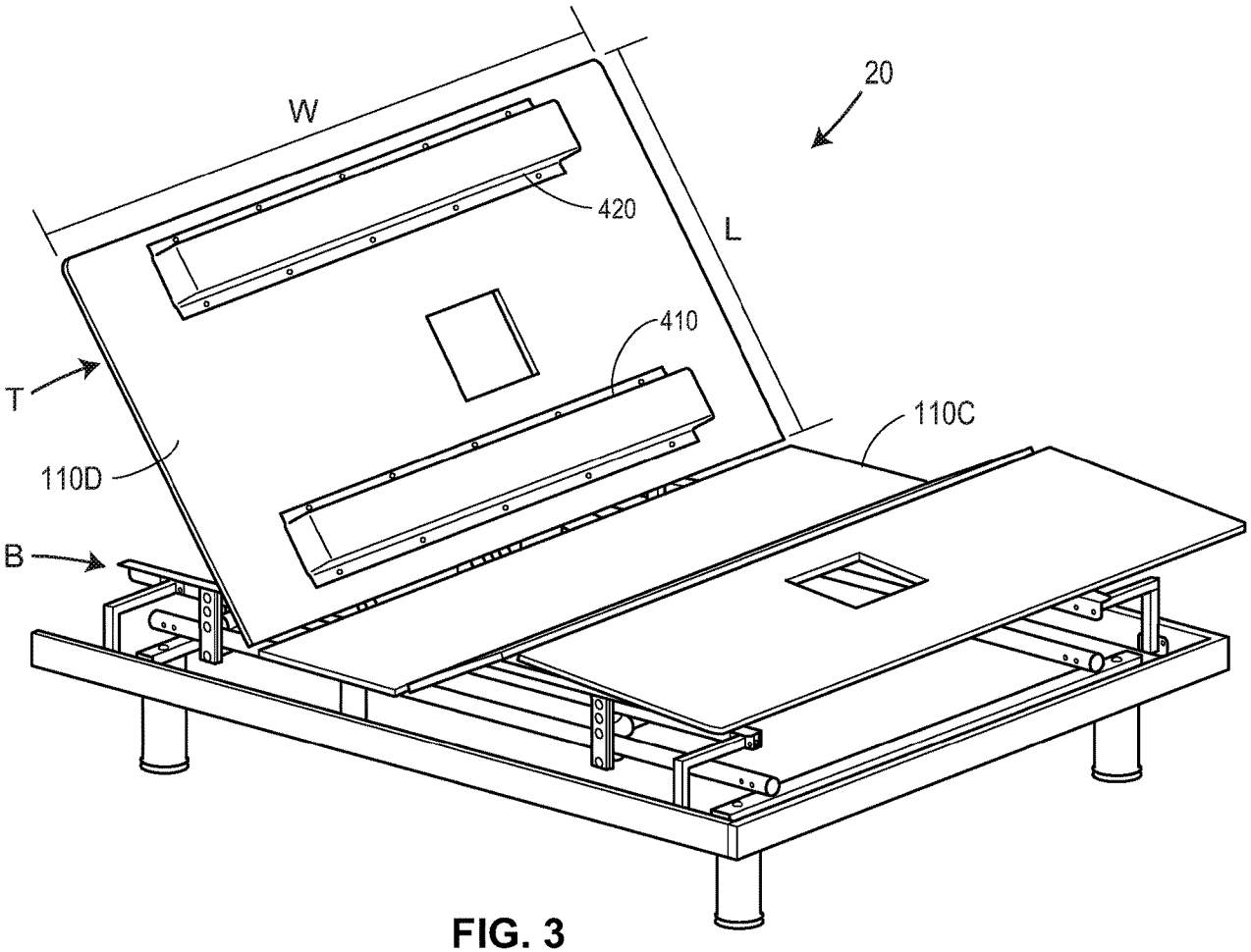
FIG. 3 is a front perspective view of an adjustable bed according to the disclosure including inflatable air bladder lumbar and neck support structures.
Figure 4:
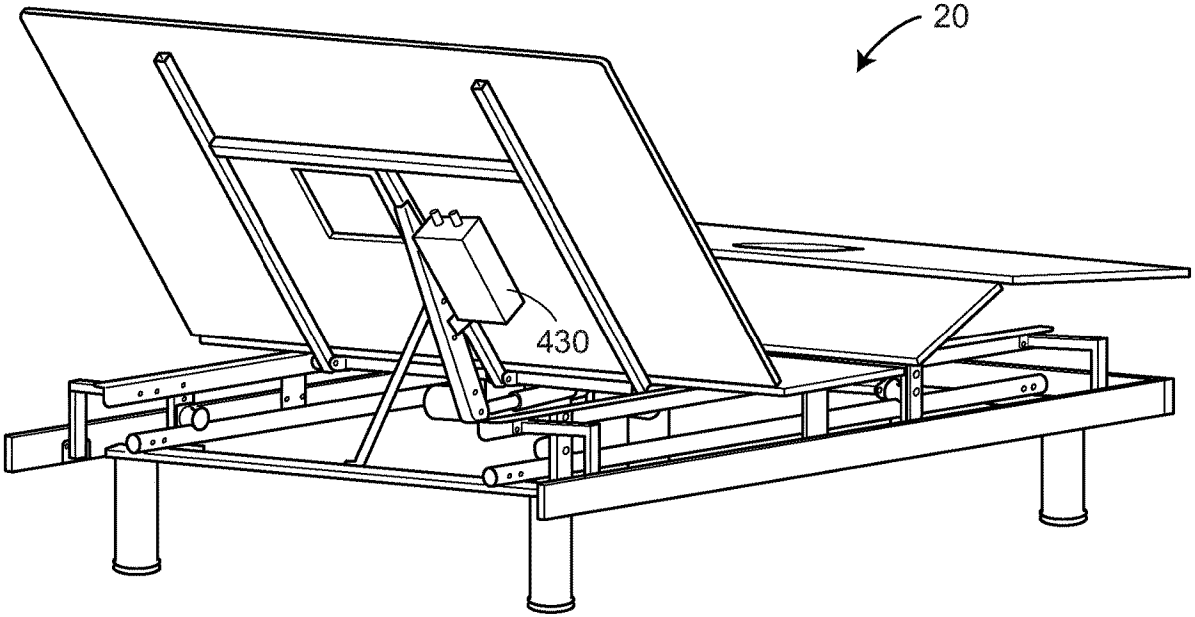
FIG. 4 is a rear perspective view of an adjustable bed according to the disclosure including inflatable air bladder lumbar and neck support structures.

FIG. 1 is a side view of an adjustable bed 10 according to the disclosure. The illustrated adjustable bed 10 includes an adjustable foundation 20 (e.g., adjustable bed foundation), a mattress 300 sitting atop the adjustable foundation 20, and a lumbar and neck support system 400 (e.g., lumbar support structure 410 and neck support structure 420 positioned at one or more locations on a back/head portion of the foundation 20 and in direct or indirect contact with the mattress 300). The support system 400 as illustrated in the figures includes a lumbar support structure 410 and a neck support structure 420. In some embodiments, the neck support structure 420 is optional and can be omitted (e.g., the system 400 includes only the lumbar support structure 410). In some embodiments, the lumbar support structure 410 is optional and can be omitted (e.g., the system 400 includes only the neck support structure 420). The adjustable foundation 20 can include a mattress support (or deck) 100 mounted to an adjustable frame 200. FIG. 2 is a top perspective illustration of a mattress 300 according to the disclosure.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 110$C_1$ and 110$C_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a fourth (foot) support section 110A, a third (leg) support section 110B pivotally attached to the fourth section 110A, a second (bottom) support section 110C pivotally attached to the third section 110B, and a first (back/neck/head) support section 110D pivotally attached to the second section 110C as shown in FIG. 1. In other embodiments (not shown), the mattress support 100 can have fewer or more support sections (e.g., a third (foot) support section, a second (leg and bottom) support section pivotally attached thereto, and a first (back/head/neck) support section pivotally attached thereto). In some embodiments the support sections 110A-110D can be formed from a rigid support material such as wood or metal. In other embodiments the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

As illustrated, the adjustable frame 200 further includes a subframe 230, for example a rigid, non-articulatable frame structure which sits on a floor or within a decorative bed frame common in the furniture industry such as a platform bed (e.g., via various leg elements, not shown) and provides stability for the bed foundation 20 as the adjustable frame 200 is articulated to various different positions. The adjustable frame 200 can further include one or more support members 220 connecting structure between the subframe 230 and the frame support 210 and sections 210A-210D thereof. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include one or more actuators 240 variously mounted to one or more of the subframe 230, a support member 220, and a frame support section 210A-210D. In some embodiments, the subframe 230, the support members 220, and the frame support sections 210A-210D can be formed from metal such as steel. The actuators 240 can be any of those commonly known in the art. The actuators 240 and, correspondingly, the configuration or position of the adjustable frame 200, mattress support 100, and mattress 300 can be controlled and adjusted by a suitable power supply (not shown), adjustable bed controller 250 (e.g., programmable logic controller or otherwise), and remote control to deliver repositioning commands (not shown).

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. The mattress suitably has a thickness of at least 20 cm (e.g., at least 20 cm, 30 cm, or 35 cm and/or up to 30 cm, 40 cm, or 50 cm). In the illustrated embodiment, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material. The mattress 300 is generally positioned above the mattress support 100 surface 112, for example sitting directly atop the deck support sections 110A-110D. In other embodiments, other structure between the mattress 300 and mattress support 100 surface 112 can be present, for example a padding or cushion material.

FIGS. 3-6 illustrate an embodiment in which the lumbar and neck support system 400 includes an inflatable lumbar support 410 and an inflatable neck support 420. Suitably, the inflatable supports 410, 420 are formed from a durable fabric or plastic material. The inflatable lumbar support 410 is positioned in a bottom region B of the first deck support section 110D (e.g., bottom 20%, 30%, 40%, or 50% of longitudinal length L of the first deck support section 110D, measured relative to the end of the first deck support section 110D adjacent the second deck support section 110C), such that the lumbar support 410 exerts pressure when inflated against the lumbar region of a person laying or sitting on the adjustable bed 10. Similarly, the inflatable neck support 420 is positioned in a top region T of the first deck support section 110D (e.g., top 20%, 30%, 40%, or 50% of longitudinal length L of first deck support section 110D, measured relative to the end of the first deck support section 110D corresponding to the head end of the adjustable bed 10), such that the neck support 420 exerts pressure when inflated against the neck region of a person laying or sitting on the adjustable bed 10. The inflatable lumbar support 410 laterally extends across the first deck support section 110D and is disposed on an upper surface 112D of the first deck support section 110D. Suitably, the inflatable lumbar support 410 and/or the inflatable neck support 420 extends at least 60%, 70%, 80%, or 90% of the mattress support surface 100 lateral width W. In some embodiments, the inflatable lumbar support 410 and/or the inflatable neck support 420 is a single inflatable bladder extending across the first deck support section 110D (e.g., at least 60%, 70%, 80%, or 90% of the lateral width W of the mattress support surface 200 or the first deck support section 110D, such as for a twin, queen, or king size bed). In other embodiments, the inflatable lumbar support 410 and/or the inflatable neck support 420 includes a plurality of inflatable bladders 410A, 410B and/or 420A, 420B extending across the first deck support section 110D. For example, there can be two separate bladders on adjacent support halves corresponding to a bed section for a first person and a second person such as on a queen, split queen, king, or split king bed 10. The plurality of bladders can be in fluid communication so that they inflate/deflate together, or they can be fluidly isolated from each other so that they can be independently inflated and deflated. As specifically shown in FIG. 4, the bed 10 can further include a means 430 for supplying pressure to the inflatable lumbar support 410 and the inflatable neck support 420, for example including an air pump or compressor along with suitable valves and tubing (not shown) for independently inflating and deflating the various supports/bladders.

Figure 5:
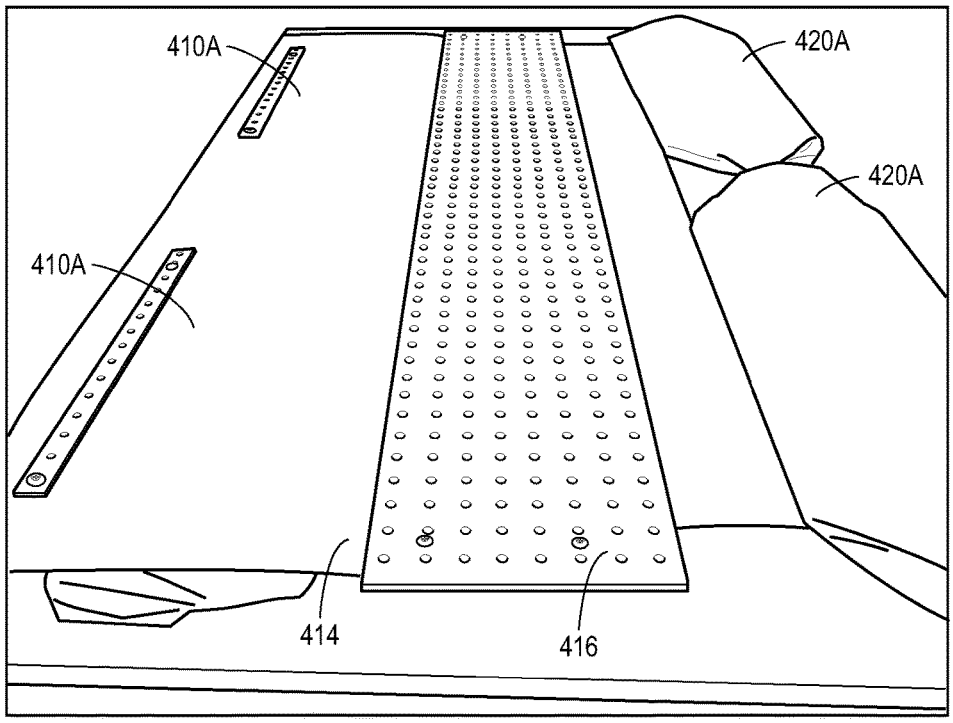
FIG. 5 is a top perspective view of an adjustable bed according to the disclosure including inflatable air bladder lumbar and neck support structures and a pressure distribution member in a relaxed state.
Figure 6:
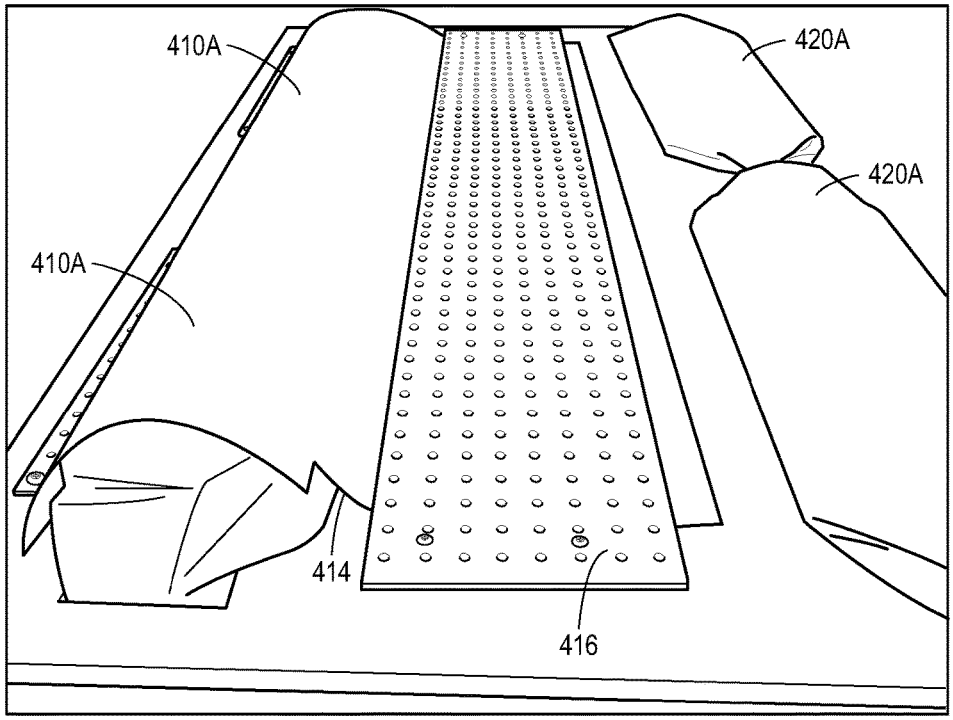
FIG. 6 is a top perspective view of an adjustable bed according to the disclosure including inflatable air bladder lumbar and neck support structures and a pressure distribution member in an extended state.
Figure 7:
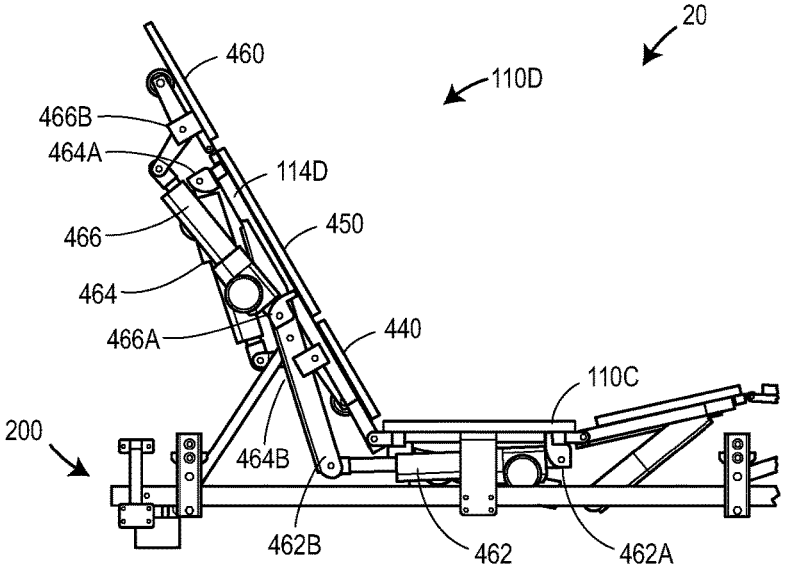
FIG. 7 is a side view of an adjustable bed according to the disclosure including mechanical lumbar and neck support structures in a flat state.
Figure 8:
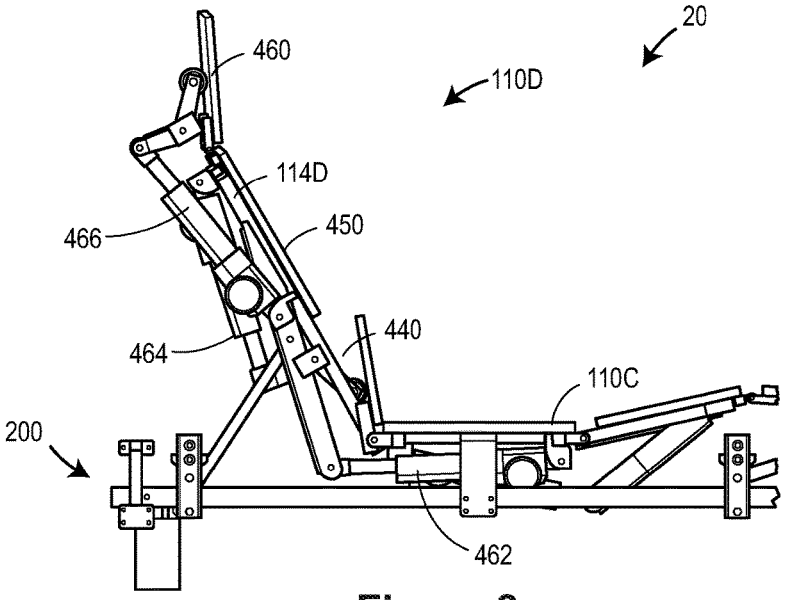
FIG. 8 is a side view of an adjustable bed according to the disclosure including mechanical lumbar and neck support structures in an articulated state.
Figure 9:
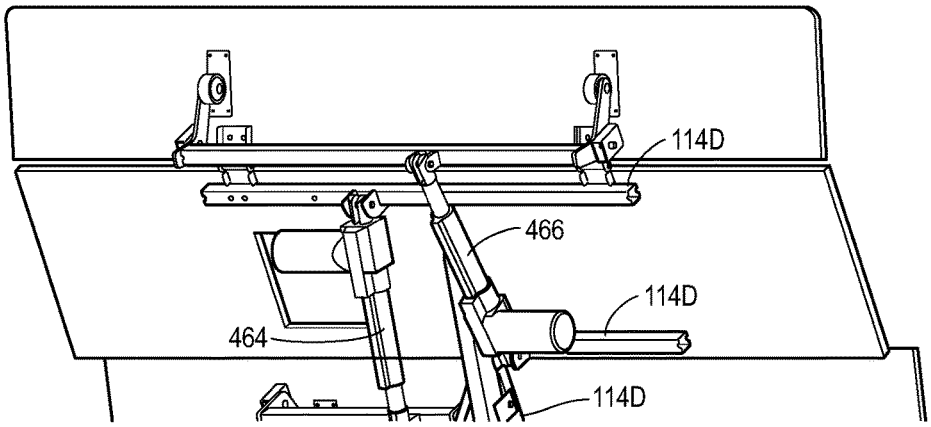
FIG. 9 is an upper rear perspective view of an adjustable bed according to the disclosure including mechanical lumbar and neck support structures in an articulated state.
Figure 10:
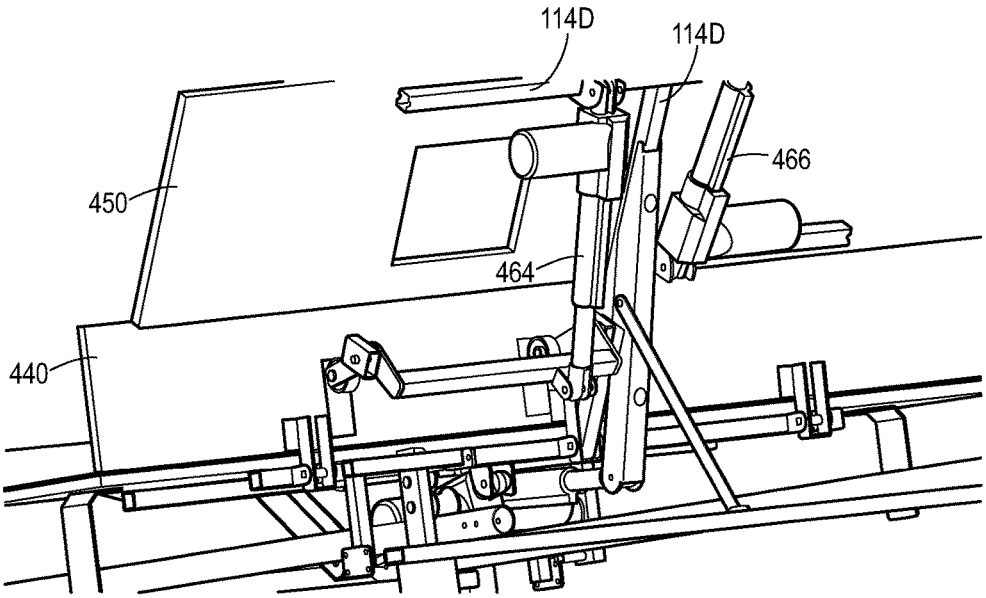
FIG. 10 is a lower rear perspective view of an adjustable bed according to the disclosure including mechanical lumbar and neck support structures in an articulated state.
Figure 11:
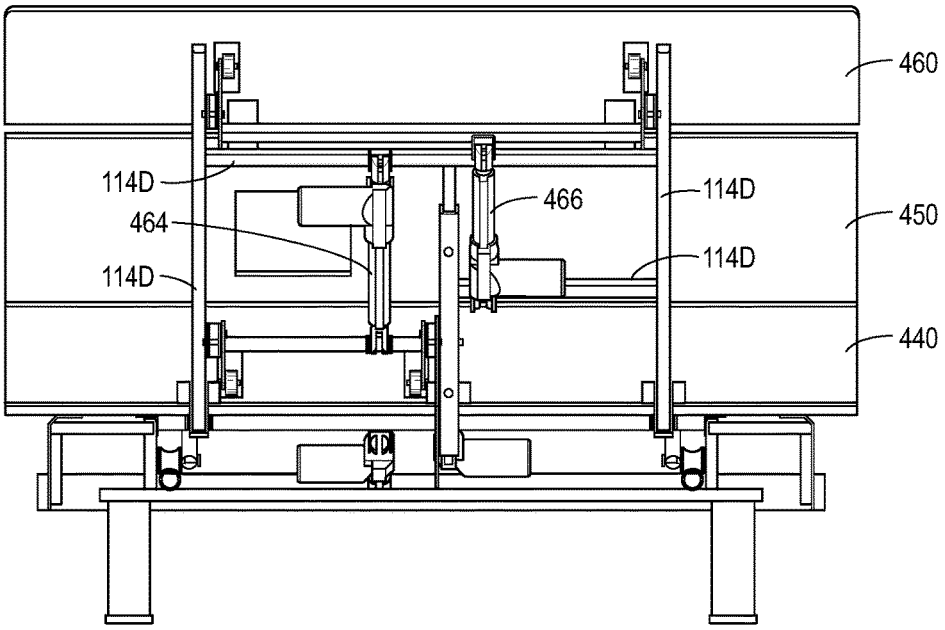
FIG. 11 is a rear view of an adjustable bed according to the disclosure including mechanical lumbar and neck support structures in a flat state.

In a particular embodiments shown in FIGS. 5 and 6, the bed 10 can further include a flexible lumbar pressure distribution member 414 mounted to the first deck support 110D section and at least partially covering or enclosing the inflatable lumbar support 410. Similarly, the bed can include an analogous flexible neck pressure distribution member (not shown) mounted to the first deck support section 110D and at least partially covering or enclosing the inflatable neck support 420. For example, the pressure distribution member can be a thin but rigid plastic material or sheet that can deform and conform to the curvature of the underlying bladder, but which provides lateral support to laterally distribute the pressure of a person's lumbar/back or head/neck to lessen bladder sag in the region where the person is located. One longitudinal end of the pressure distribution member can be fixedly mounted to the first deck support section 110D and the opposing longitudinal end can have a floating or sliding mount such as through a sleeve 416 fixedly mounted to the first deck support section 110D (e.g., where the illustrated sleeve 416 can further accommodate a complementary neck pressure distribution member when present).

FIGS. 7-11 illustrate an embodiment in which the lumbar and neck support system 400 is in the form of a multi-section first deck support section 110D. The first deck support section 110D includes a longitudinally extending support frame 114D (e.g., steel or other metal) pivotally attached to the second deck support section 110C, a lumbar support deck section 440, a back support deck section 450, and a head support deck section 460. The a back support deck section 450 is fixedly mounted to an upper surface of a middle section of the support frame 114D. The a lumbar support deck section 440 is pivotally mounted to the second deck support section 110C and is positioned above an upper surface of a bottom section of the support frame 114D (e.g., having an opposing free end adjacent the back support deck section 450). The head support deck section 460 is pivotally mounted to the support frame 114D and is positioned above an upper surface of a top section of the support frame 114D (e.g., having an opposing free end at the head end of the bed 10).

The lumbar and neck support system 400 further includes first, second, and third actuators 462, 464, and 466. The first actuator 462 has a first end 462A mounted to one or more of the second deck support section 110C (e.g., a supporting frame member thereof) and the stationary bed frame 200, and a second end 462B mounted to the support frame 114D. The first actuator 462 is adapted to move the support frame 114D between articulated and substantially flat positions relative to the stationary bed frame 200. Suitably, the first end 462A has a fixed pivotal attachment to the second deck support section 110C and/or the stationary bed frame 200, and the second end 462B has a fixed pivotal attachment to the support frame 114D. The second actuator 464 has a first end 464A mounted to the support frame 114D, and a second end 464B mounted to the lumbar support deck section 440. The second actuator 464 is adapted to move the lumbar support deck section 440 between articulated and substantially flat positions relative to the support frame 114D. Suitably, the first end 464A has a fixed pivotal attachment to the support frame 114D, and the second end 464B has a floating pivotal attachment to the lumbar support deck section 440 (e.g., floating wheels or rollers contacting the lumbar support deck section 440). The third actuator 466 has a first end 466A mounted to the support frame 114D, and a second end 466B mounted to the neck support deck section 460. The third actuator 466 is adapted to move the neck support deck section 466 between articulated and substantially flat positions relative to the support frame 114D. Suitably, the first end 466A has a fixed pivotal attachment to the support frame 114D, and the second end 466B has a floating pivotal attachment to the neck support deck section 460 (e.g., floating wheels or rollers contacting the neck support deck section 460).

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 and 2014/0325761 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the apparatus, methods, or processes are described as including components, steps, or materials, it is contemplated that the apparatus, methods, or processes can also comprise, consist essentially of, or consist of, any combination of the recited components or materials, unless described otherwise.

PARTS LIST

10 adjustable bed (including mattress support 100, adjustable frame 200, mattress 300, and lumbar and neck support system 400)

20 adjustable foundation (including mattress support 100, adjustable frame 200, and lumbar and neck support system 400)

100 mattress support (or deck) surface

110 deck support (sections 110A-D as foot, leg, bottom, and back/head portions; longitudinally opposed ends 110$A_1$ and 110$A_2$, 110$B_1$ and 110$B_2$, 110$C_1$ and 110$C_2$, 110$D_1$ and 110$D_2$)

112 top surface of deck support (sections 112A-D as for deck support)
200 adjustable (bed) frame
210 frame support (sections 210A-D as for deck support)
220 support member
230 subframe
240 actuator or movement/articulation means
250 adjustable bed controller
300 mattress (300A: foot end; 300D: head end)
305 containment frame
310 base
320 sidewalls
330 endwalls
340 foam cells or foam springs
400 lumbar and neck support system
410 lumbar support structure
414 flexible lumbar pressure distribution member
416 sleeve
420 neck support structure
430 means for supplying pressure
440 lumbar support deck section
450 back support deck section
460 neck support deck section
462, 464, 466 first, second, and third actuators
X (local) lateral direction
Y (local) longitudinal direction
Z (local) normal direction
P pivot axis
Θ angle of articulation between adjacent sections

What is claimed is:

1. An adjustable bed comprising:

(a) a stationary bed frame; and (b) a mattress support surface supported by the stationary bed frame and comprising (i) a first deck support section corresponding to a back and head portion of the mattress support surface, and (ii) a second deck support section pivotally attached to the first deck support section;

the first deck support section comprising:

a longitudinally extending support frame pivotally attached to the second deck support section;

a back support deck section fixedly mounted to an upper surface of a middle section of the support frame;

a first actuator having (A) a first end mounted to one or more of the second deck support section and the stationary bed frame, and (B) a second end mounted to the support frame, wherein the first actuator is adapted to move the support frame between articulated and substantially flat positions relative to the stationary bed frame;

a lumbar support deck section pivotally mounted to the second deck support section and positioned above an upper surface of a bottom section of the support frame; and a second actuator having (A) a first end mounted to the support frame, and (B) a second end mounted to the lumbar support deck section, wherein the second actuator is adapted to move the lumbar support deck section between articulated and substantially flat positions relative to the support frame.

2. The adjustable bed of claim 1, wherein the first end of the first actuator has a fixed pivotal attachment to the one or more of the second deck support section and the stationary bed frame, and the second end of the first actuator has a fixed pivotal attachment to the support frame.

3. The adjustable bed of claim 1, wherein the first end of the second actuator has a fixed pivotal attachment to the support frame, and the second end of the second actuator has a floating pivotal attachment to the lumbar support deck section.

4. The adjustable bed of claim 1, wherein:

the first deck support section further comprises: a neck support deck section pivotally mounted to the support frame and positioned above an upper surface of a top section of the support frame, and a third actuator having (A) a first end mounted to the support frame, and (B) a second end mounted to the neck support deck section, wherein the third actuator is adapted to move the neck support deck section between articulated and substantially flat positions relative to the support frame, the first end of the third actuator has a fixed pivotal attachment to the support frame, and the second end of the third actuator has a floating pivotal attachment to the neck support deck section.

5. The adjustable bed of claim 1, wherein the mattress support surface further comprises (iii) a third deck support section pivotally attached to the second deck support section, and (iv) optionally a fourth deck support section pivotally attached to the third deck support section.

6. The adjustable bed of claim 1, further comprising a mattress positioned above the mattress support surface.

7. The adjustable bed of claim 6, wherein the mattress is selected from the group consisting of a spring mattress, a coil mattress, a memory foam mattress, and an air mattress.

8. The adjustable bed of claim 1, wherein the adjustable bed comprises first and second mattress support surfaces arranged in a side-by-side configuration, and first and second lumbar support deck sections positioned on the respective first deck support sections.

* * * * *